US011122875B1

(12) United States Patent
Henderson

(10) Patent No.: US 11,122,875 B1
(45) Date of Patent: Sep. 21, 2021

(54) COOLER, IN PARTICULAR AN EXPANDABLE COOLER WHICH HAS A PANEL SUITABLE FOR OTHER PURPOSES

(71) Applicant: Charles A. Henderson, Hattiesburg, MS (US)

(72) Inventor: Charles A. Henderson, Hattiesburg, MS (US)

( * ) Notice: Subject to any disclaimer, the term of this patent is extended or adjusted under 35 U.S.C. 154(b) by 0 days.

(21) Appl. No.: 15/701,083

(22) Filed: Sep. 11, 2017

(51) Int. Cl.
*A45C 11/20* (2006.01)
*F25D 3/08* (2006.01)
*F25D 23/06* (2006.01)

(52) U.S. Cl.
CPC ..... *A45C 11/20* (2013.01); *F25D 3/08* (2013.01); *F25D 23/063* (2013.01); *F25D 2323/061* (2013.01)

(58) Field of Classification Search
CPC ..... B35B 63/08; B65D 83/00; B65D 83/72; A45C 11/20; A47J 41/00; F25D 3/00; F25D 3/02; F25D 3/06; F25D 3/08; F25D 23/028; F25D 23/04; F25D 23/06; F25D 23/063; F25D 2323/02; F25D 2323/06; F25D 2323/061; A45F 4/02; A45F 224/577; A45F 5/417
USPC ..... 62/371, 440, 457.1, 457.7; 206/170; 220/500, 592.2; 229/117.01; 224/577; 5/417, 418, 419, 420, 421
See application file for complete search history.

(56) References Cited

U.S. PATENT DOCUMENTS 3,262,283 A * 7/1966 Taylor ..... F25D 3/08 62/372
2,960,136 A * 6/1982 Davis ..... A45C 3/00 190/111
4,812,054 A * 3/1989 Kirkendall ..... A45C 3/04 383/110
5,140,833 A * 8/1992 Whalen ..... A45C 3/10 150/154
5,263,339 A * 11/1993 Evans ..... B65D 5/46112 229/104
5,863,088 A * 1/1999 Kelly, Sr. ..... A45C 3/10 294/146
6,193,034 B1 * 2/2001 Fournier ..... A45C 7/0095 190/107
6,409,066 B1 * 6/2002 Schneider ..... A45F 3/02 190/110

(Continued)

*Primary Examiner* — Len Tran
*Assistant Examiner* — Gustavo A Hincapie Serna
(74) *Attorney, Agent, or Firm* — Shlesinger, Arkwright & Garvey LLP

(57) ABSTRACT

Expandable cooler includes a front wall, a rear wall, an interior, an exterior, and a front hinge. A front panel hingedly attached to the expandable cooler, front hinge being between the front panel and the cooler. Front panel has a surface and is movable away from front wall of cooler into an expanded position. Front panel is foldable about front hinge so front panel extends away from expandable cooler, and surface on front panel faces upwardly and surface can receive a person or an object on it, such as a picnic, toys, or for lying down or sunbathing. Foldable front panel includes a second front panel hingedly attached to front panel by a front panel hinge, second front panel has a surface, and second front panel is movable about front panel hinge and lies facing upwardly, and second surface receives an object on it in the expanded position.

9 Claims, 3 Drawing Sheets

(56) References Cited

U.S. PATENT DOCUMENTS 7,140,773 B2 * 11/2006 Becker ..... B65D 5/5088 383/99
7,222,705 B1 * 5/2007 Guza ..... A45C 15/00 190/1
7,682,080 B2 * 3/2010 Mogil ..... A45C 11/20 383/110
7,926,295 B2 * 4/2011 Brand ..... B65D 5/541 62/457.1
8,911,339 B2 * 12/2014 De Paula ..... B65D 5/40 493/128
2005/0279124 A1 * 12/2005 Maldonado ..... F25D 3/08 62/457.7
2006/0032881 A1 * 2/2006 Price ..... A45F 4/02 224/576
2006/0118376 A1 * 6/2006 Godshaw ..... A45C 13/04 190/107
2006/0198562 A1 * 9/2006 Mogil ..... A45C 7/0077 383/121.1
2009/0120978 A1 * 5/2009 Lesser ..... A45C 15/00 224/191
2009/0206092 A1 * 8/2009 Erberich ..... A45C 11/20 220/556
2009/0294237 A1 * 12/2009 Sisitsky ..... A45C 13/02 190/103
2010/0236953 A1 * 9/2010 Myers ..... A45C 7/0095 206/223
2011/0284598 A1 * 11/2011 Lawson ..... A45F 3/04 224/153
2012/0128270 A1 * 5/2012 West ..... B65D 37/00 383/6
2013/0279037 A1 * 10/2013 Wong ..... B60J 11/00 359/871
2015/0225164 A1 * 8/2015 Seiders ..... A45C 13/103 220/592.25
2015/0253056 A1 * 9/2015 Richardson ..... F25D 3/08 62/457.7
2016/0345783 A1 * 12/2016 Nehir ..... A47J 47/14
2017/0055665 A1 * 3/2017 Lanzisera ..... A45C 11/20
2018/0192824 A1 * 7/2018 Mogil ..... A45C 3/001

* cited by examiner

FIG. 1
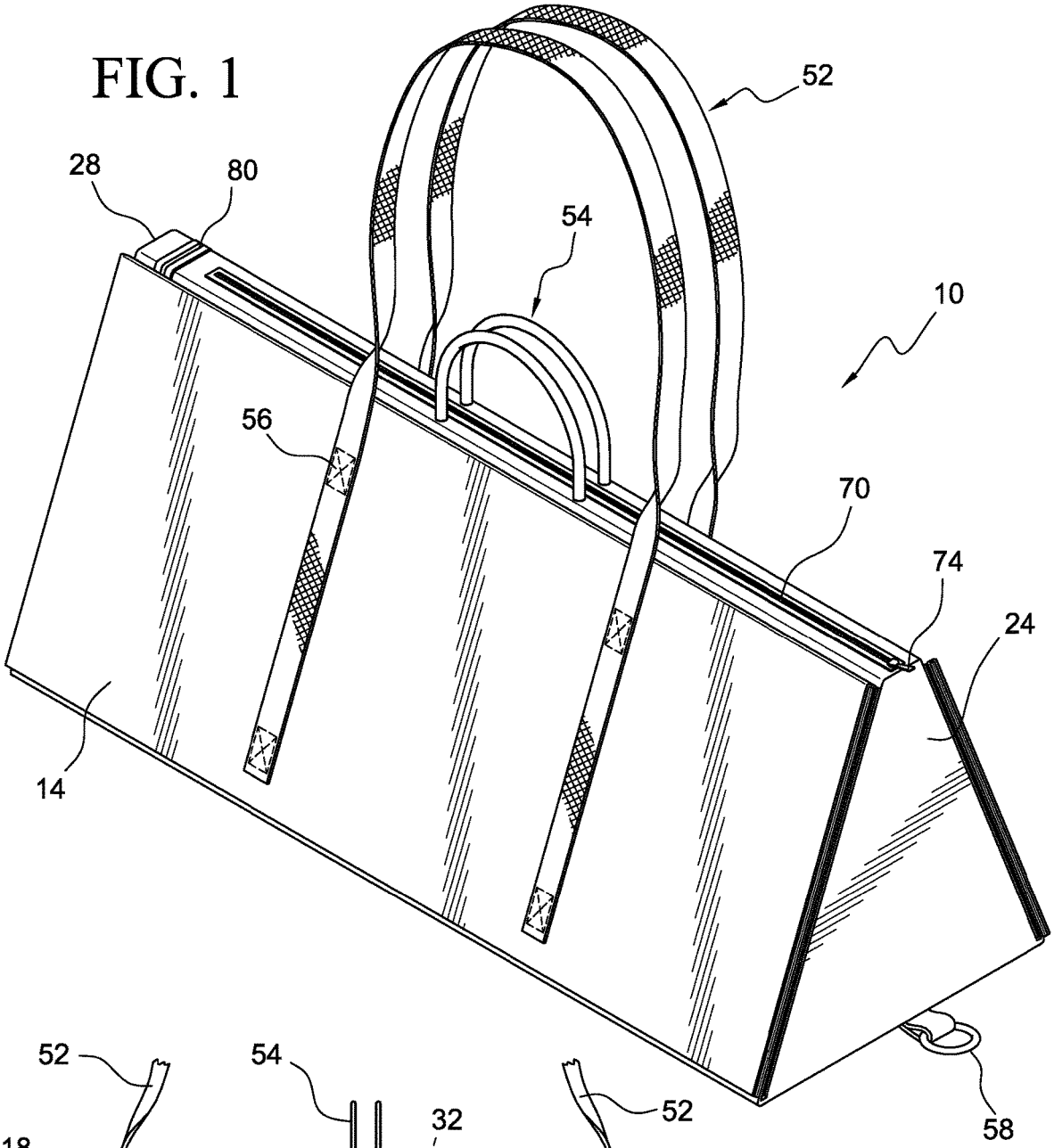
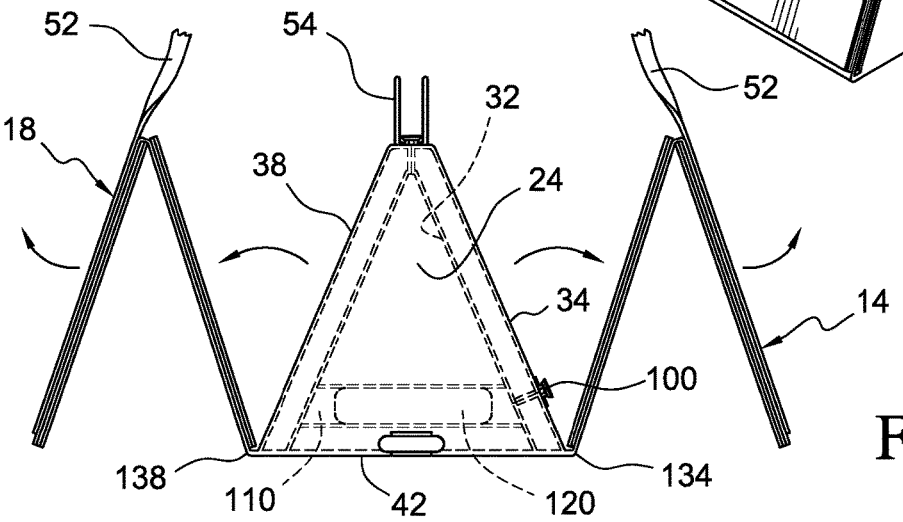
FIG. 2

FIG. 3
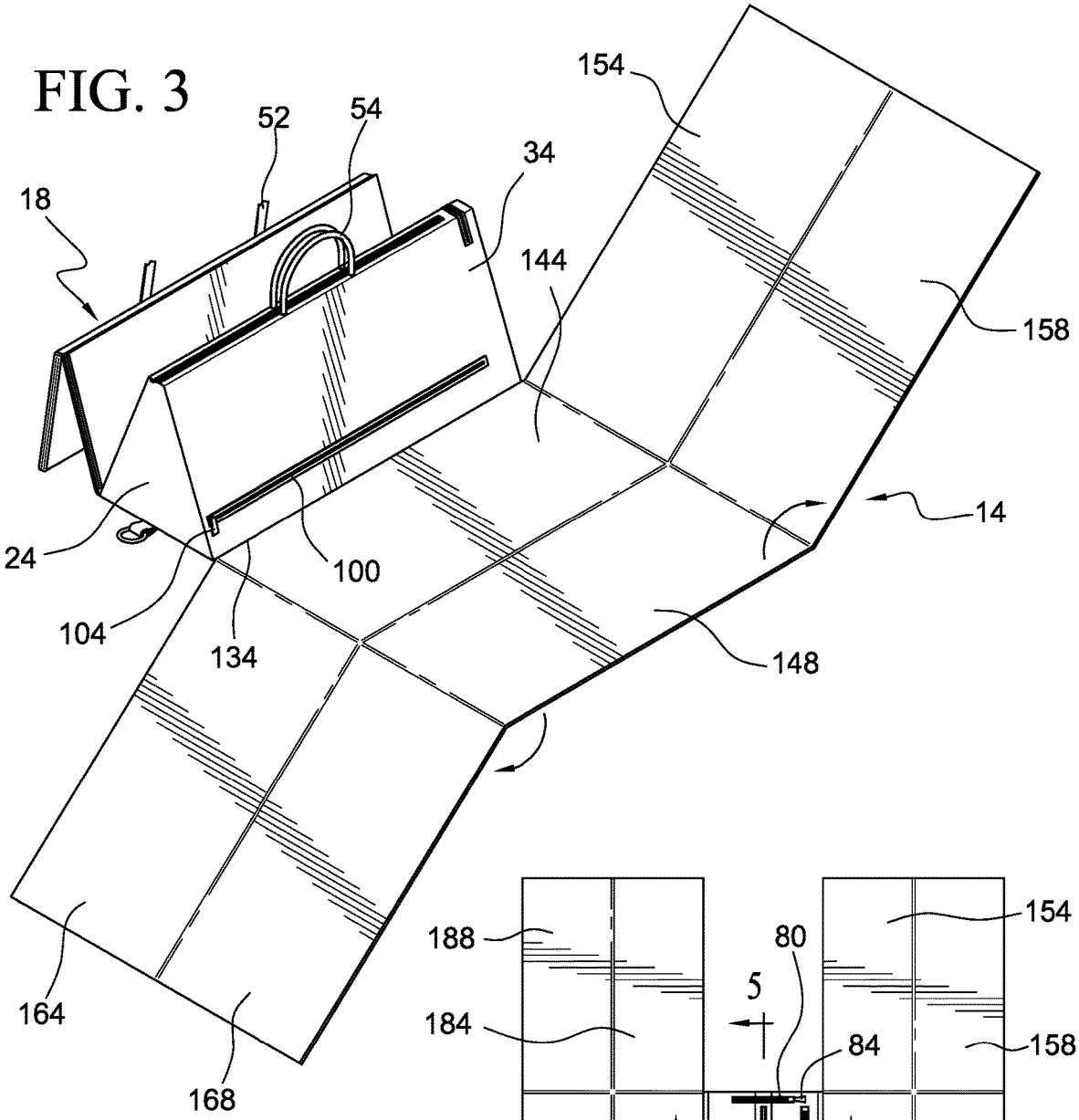
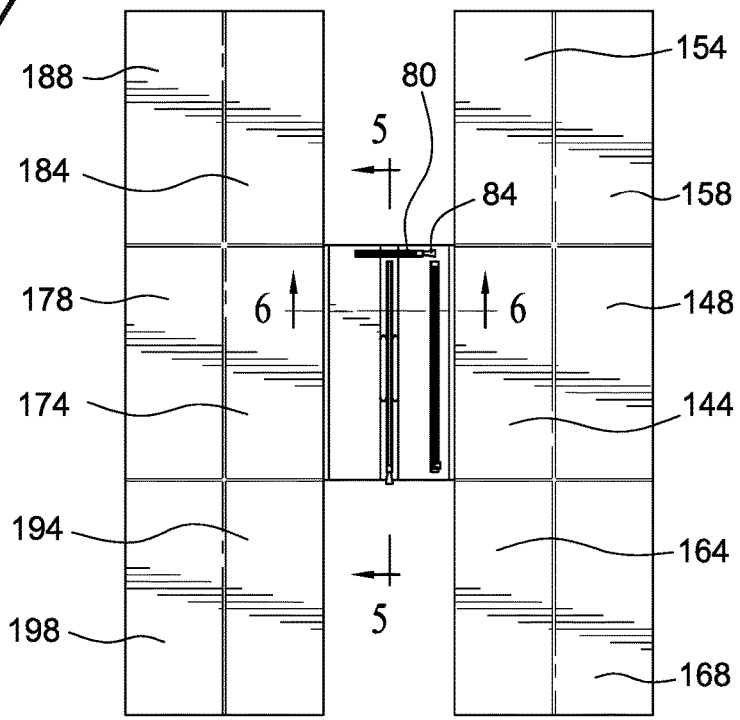
FIG. 4

COOLER, IN PARTICULAR AN EXPANDABLE COOLER WHICH HAS A PANEL SUITABLE FOR OTHER PURPOSES

FIELD OF THE INVENTION

The present invention relates to a cooler. More particularly, the invention relates to an expandable cooler which has a panel usable for other purposes. Even more particularly, the invention relates to an expandable cooler which has a panel which may provide a surface on which a user may picnic or lie down in its expanded position.

BACKGROUND OF THE INVENTION

Coolers are known.

Known coolers include substantially rectangular, box-like coolers with removable tops and which may have insulated or uninsulated sides.

Further, coolers are known which are made of soft plastic sides with partially insulated covers, such as for taking lunch to a school or office. Such known coolers may have ice or blocks of cooling material placed in the interior of the coolers along with a product to be cooled, such as food.

Further, reusable blocks of a cooling material, such as a refreezable material, such as a liquid, encased within a housing are known. Such known refreezable blocks or packs may have the shape of a brick.

Drawbacks of known coolers include that they are generally built for only one purpose, and unsuitable for multiple uses.

As will be readily appreciated, such known coolers have other drawbacks.

OBJECTS AND SUMMARY OF THE INVENTION

It is an object of the invention to overcome the drawbacks of the prior art.

Another object of the invention is to provide a cooler, which has multiple uses; i.e., more functions than just keeping items cool.

A further object of the invention is to provide an expandable cooler, which may have a panel for use by a user for various purposes, such as a panel having a surface on which children may play, a family may picnic, or one may lie down and rest or sunbath, for example.

Another object of the invention is to provide an expandable cooler, which may have a panel, which folds out and has multiple subpanels, which may be termed panels, for compactness.

A further object of the invention is to provide a cooler which is easily reusable and, thus, environmentally friendly, and cost-effective to own and use.

Another object of the invention is to provide an expandable cooler which is usable as a cooler, which has front and rear side panels, which may be folded out, for example, to provide additional surfaces for use by a user.

Still further, another object of the invention is to provide a cooler which accommodates one or more pieces of cooling material, such as refreezable cold packs, that can be removed and replaced in a pocket in the cooler.

Still further, it is an object of the invention to provide a multi-purpose cooler which is easily constructed, as well as easily used by a consumer.

Another object of the invention is to provide a cooler in which hot air in the interior of the cooler goes to an uppermost part of the interior.

A further object of the invention is to provide a cooler in which the cooler is able to be opened at the uppermost part of the cooler in order to release the hot air, and in order to move food or drink, for example, into and out of the cooler.

A still further object of the invention is to provide a cooler which has a substantially trapezoidal configuration, such as a trapezoid which is taller than it is wide, to ensure that hot air is located at an uppermost part of the interior of the cooler.

Further, it is an object of the invention to provide attachments for carrying an expandable cooler, such as shoulder straps, hand grips, straps, or rings, with which the cooler can be carried by hand or by being attached to a backpack, for example, for ease of transportation.

In sum, the invention, as described herein, includes an expandable cooler including a front wall, a rear wall, an interior, an exterior, and a front hinge. A front panel hingedly attached to the cooler, the front hinge being located between the front panel and the cooler, the front panel having a surface and being movable away from the front wall of the cooler. The front panel is foldable about the front hinge so that the front panel extends away from the cooler, and the surface on the front panel faces upwardly; and the surface which faces upward on the front panel receives an object on it.

Further, the expandable cooler according to the invention includes that the front panel has a first front panel and a second front panel hingedly attached to the first front panel by a front panel hinge or second hinge. The second front panel has a surface, and the second front panel is movable about the second hinge and faces upwardly; and, the surface on the second front panel receives an object thereon.

The expandable cooler according to the invention further includes that there may be a third front panel is hingedly attached to the first front panel, a fourth front panel hingedly attached to the second front panel, and the third front panel and the fourth front panel have respective surfaces thereon. In that manner the third and fourth front panels can be moved away from the front panel and the second front panel, respectively, and each of the respective surfaces faces upwardly and receives a respective object thereon.

Further, the expandable cooler according to the invention includes that there may be a fifth front panel hingedly attached to the first front panel, and a sixth front panel hingedly attached to the second front panel, the fifth front panel and the sixth front panel have respective surfaces thereon. The fifth and sixth front panels are moved away from the first front panel and the second front panel, respectively, and each of the respective surfaces face upwardly and receive a respective object thereon.

The cooler according to the invention further includes that a rear panel is hingedly attached to the cooler, a rear hinge is located between the rear panel and the cooler, the rear panel having a surface and being movable away from the rear wall of the cooler. The rear panel is foldable about the rear hinge so that the rear panel extends away from the cooler, and the surface on the rear panel faces upwardly; and the surface which faces upward on the rear panel receives an object on it, in use.

The cooler according to the invention further includes that the rear panel includes a first rear panel and a second rear panel hingedly attached to the first rear panel by a rear panel hinge or second hinge, the second rear panel has a surface, and the second rear panel is movable about the second hinge and faces upwardly. In a manner similar to the front panel, the rear panel may include a third rear panel, a fourth rear panel, a fifth rear panel, and a sixth rear panel, each of which rear panels is hingedly attached to one or more of the other rear panels, respectively, and each of which receives an object thereon, in use.

In sum, the invention comprises, includes, consists of, and consists essentially of an expandable cooler including a front wall, a rear wall, an interior, an exterior, and a front hinge. A front panel hingedly is attached to the cooler, the front hinge being located between the front panel and the cooler, the front panel having a surface and being movable away from the front wall of the cooler. The front panel is foldable about the front hinge so that the front panel extends away from the cooler, and the surface on the front panel faces upwardly; and the surface which faces upward on the front panel receives an object on it.

The term "expandable cooler" is to be understood in connection with the present invention that the expandable cooler has an unexpanded, compact transport or use position and an expanded position in which the cooler has been expanded and enlarged beyond its unexpanded, compact transport position; indeed, an expanded position in which the expandable cooler according to the invention has been expanded beyond the capabilities of existing coolers which function solely to keep food or other stored items in a cooled storage portion. In short, known coolers which cannot be expanded for other purposes.

Relative terms such as left, right, front, back, up, and down are for convenience only and are not intended to be limiting.

BRIEF DESCRIPTION OF THE DRAWINGS

The objects and features of the invention noted above are explained in more detail with reference to the drawings, in which like reference numerals denote like elements, and in which:

FIG. 1 is a top front perspective view of the expandable cooler according to the present invention in a closed position;

FIG. 2 is a side view of the cooler of FIG. 1 in a partially open position;

FIG. 3 is a top view of the expandable cooler of FIG. 1 in a partially open position that is further open than in the FIG. 2 position;

FIG. 4 is top view of the expandable cooler of FIG. 1 in its fully open position;

DETAILED DESCRIPTION OF THE INVENTION

Figure 5:
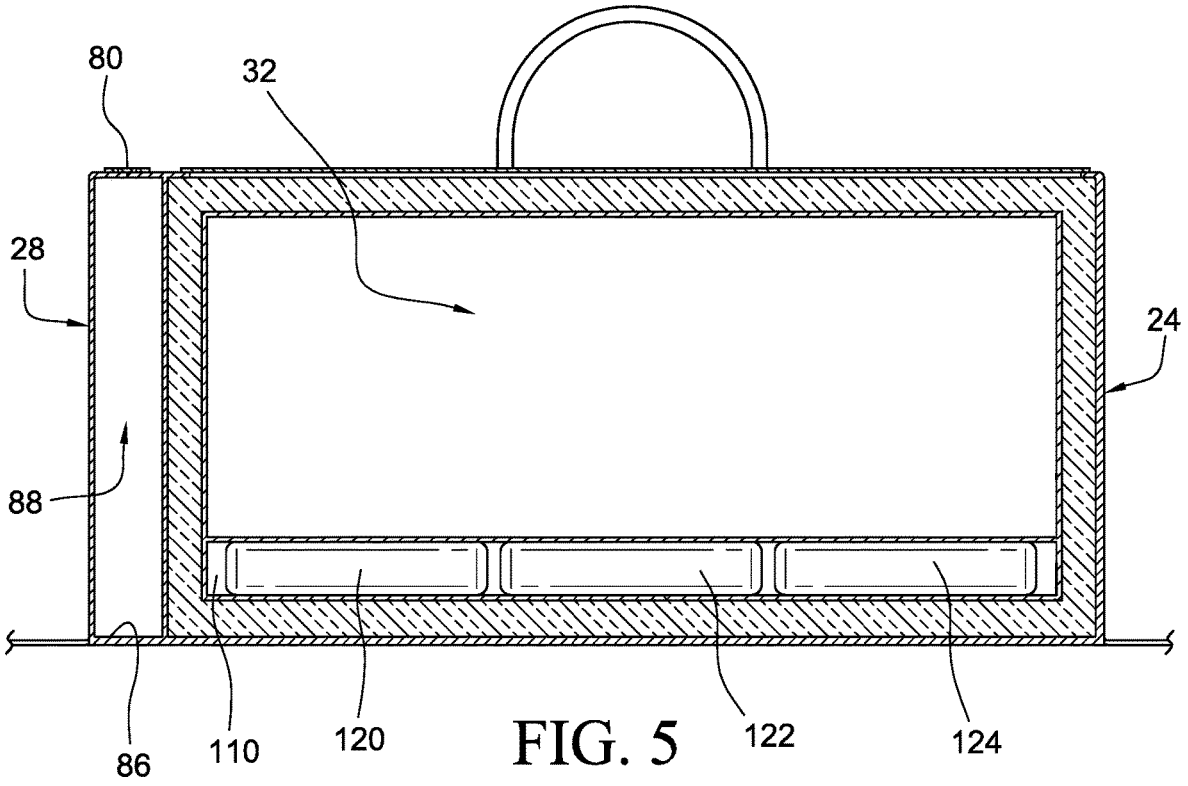
FIG. 5 is a cross-sectional view taken along line 5-5 of the fully open cooler of FIG. 4.
Figure 6:
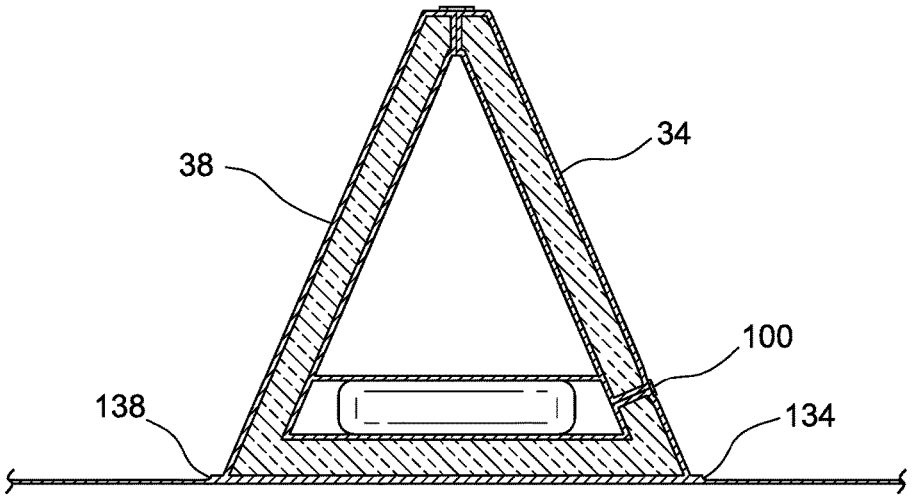
FIG. 6 is a cross-sectional view taken along line 6-6 of the fully open cooler of FIG. 4.

FIGS. 1-6 illustrate an embodiment of an expandable cooler 10 according to the invention.

Cooler 10 may have a front panel 14 and a rear panel 18 which enhance and extend the usefulness of the cooler.

Expandable Cooler 10 may further include a front panel 14 and a rear panel 18, as well as a triangular right side wall 24 and a triangular left side wall 28, which define a housing having an interior 32 along with a front wall 34 and a rear wall 38. That is, the housing may include front wall 34, rear wall 38, triangular right side wall 24, triangular left side wall 28, and interior 32. There will typically be a bottom wall 42, as will be readily appreciated, so that cooler 10 may be supported on the ground or another object in use. Respective bases of triangular right side wall 24 and triangular left side wall 28 are adjacent bottom wall 42. Respective apexes of triangular right side wall 24 and triangular left side wall 28 are adjacent the opening at the uppermost part of the interior 32. It is contemplated that bottom wall 42 may be suited for resting against the back of a person when cooler 10 is carried as a backpack.

To further enhance the usefulness of cooler 10, a shoulder strap or straps 52, as well as a hand grip or grips 54, may be provided for ease of transport. It is likewise contemplated, that a backpack strap or shoulder straps 52 can be used for carrying cooler 10 as a backpack, and so that the user may transport cooler 10 in various ways. Shoulder straps 52 may be attached to a middle of front panel 14 and shoulder straps 52 may be attached to a middle of rear panel 18 by stitching 56 or other attachments. It is contemplated that shoulder straps 52 are completely removable when not in use. For example, shoulder straps 52 could be looped through loops or rings attached to cooler 10. In that manner, when shoulder straps are not in use, they could be slipped through such loops or rings and removed for reinstallation when ready to be used at a future time.

To access interior 32 a zipper 70 may be provided at a top of cooler 10, and zipper 70 may be used to open interior 32 from the outside of interior 32 of the cooler, as will be readily appreciated by a person having ordinary skill in the art. Still further, a pull 74 for the zipper may be provided. There may likewise be provided a zipper 80 having a pull 84 for opening and closing a pocket 86 having an interior 88 adjacent left side wall 28, which may be best seen in FIG. 5. Pocket 86 may be sized to accommodate keys and cell phones, for example.

A further or second zipper 100 having a further or second pull 104 may be provided for opening and closing a further or second interior 110, which receives one or more ice bricks or ice packs 120, 122, 124, for example. Further interior 110 may be provided below interior 32, as shown. As will be readily appreciated, it is contemplated that frozen ice cubes or blocks of frozen water may likewise be located in interior 32. Further, it is contemplated that the further or second interior 110 for receiving a cooling material, or refreezable ice pack 120, 122, 124, as described above, be located for cooling interior 32 of the cooler.

As may be appreciated from FIGS. 2-4 in particular, front panel 14 and rear panel 18 of expandable cooler 10 can each be expanded to provide a support surface on which the user may sunbathe, picnic, play, or other activities that suit the user.

As will be appreciated from FIG. 2, front panel may be extended outwardly away from front wall 34. That outward movement may be accomplished by front panel 14 rotating about a front hinge 134 provided between cooler 10 and front panel 14. For example, front hinge 134 may be located, as shown, at a lower or bottom portion of cooler 10 where hinge 134 is attached between front wall 34 and front panel 14. In a similar manner, a rear hinge 138 may be provided between rear wall 38 and rear panel 18 so that rear panel 18 may be rotated about hinge 138 away from rear wall 38.

As may be appreciated from FIGS. 2-6, front panel 14 may further include a subpanel or subpanels which themselves may be further expanded to provide an area on which the user may picnic or sunbathe, or do other activities for which the user would like to have a support surface.

Turning to FIG. 3, front panel 14 may include a first front panel 144, as well as a second front panel 148 attached thereto. Second front panel 148 may be hingedly attached so it may be moved away from first front panel 144 to increase the usable surface area.

It is further contemplated that a third panel 154 be provided that is hingedly attached to first panel 144. In an analogous manner a fourth panel 158 may be hingedly attached to second panel 148 as well as third panel 154. The third front panel and the fourth front panel have respective surfaces thereon. Third and fourth front panels are moved away from the first front panel and the second front panel about an axis extending transversely relative to the front hinge, respectively, and each of the respective surfaces faces upwardly in an expanded position about an axis extending substantially perpendicular to front hinge 134, as shown. Even further, a fifth panel 164 may be hingedly attached to first panel 144 as well as to a sixth panel 168. Sixth panel 168 is itself hingedly attached to fourth panel 148 for movement away therefrom.

Still further, as readily appreciated from FIG. 4, rear panel 18 may likewise include a number of additional panels, as shown. In a manner analogous to front panel 14, rear panel 18 may include a first panel 174 hingedly attached to rear wall 38 by hinge 138 as described above. A second panel 178 may be hingedly attached to first panel 174. A third panel 184 may be hingedly attached to first panel 174, as well as to fourth panel 188. Fourth panel 188, in turn, may be hingedly attached to second panel 178. A fifth panel 194 may be hingedly attached to first panel 174. A sixth panel 198 may be hingedly attached to second panel 178. It will be appreciated that third panel 154 and fourth panel 158 need not be hingedly attached; rather, third panel 154 may be hingedly attached only to first panel 144, and fourth panel 158 may be attached only to second panel 148. In an analogous manner, sixth panel 168 need not be hingedly attached to fifth panel 164; rather, fifth panel 164 may be hingedly attached to first panel 144 and sixth panel 168 may be only hingedly attached to second panel 148, for example.

Each of the first, second, third, fourth, fifth, and sixth panels of the rear panel may be referred to as a first rear panel, second rear panel, and so forth, as will be readily appreciated.

Further, each of the first, second, third, fourth, fifth, and sixth panels of the rear panel may have substantially the same configuration as the rear wall, as shown.

As will be readily apparent, when some or all of the illustrated panels are folded out with their respective front surfaces facing up, as best seen in the top view of FIG. 4, then a person may lie down on one or more of the surfaces, depending on the size of the panels.

Still further, the number of panels may be varied depending on the intended use.

It is contemplated that the backpack strap may include a ring, rings, or other fasteners.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. An expandable cooler, comprising:

a) the cooler having a top, a housing, the housing including a front wall, a rear wall, a triangular right side wall, a triangular left side wall, a bottom wall, and a first interior;

b) the triangular right side wall, and the triangular left side wall each connected to the bottom wall and each having an apex at an uppermost part of the top of the cooler;

c) a first zipper at the uppermost part of the top of the cooler opening the first interior at the uppermost part of the first interior to access the interior;

d) the cooler including a second interior, the second interior being provided below the first interior, a second zipper on the front wall opening the second interior, and the second interior being sized to accommodate a refreezable cold pack;

e) a front panel being hingedly attached at a bottom portion of the front wall by a front hinge located between the front panel and the cooler, the front panel having a surface and being movable away from the front wall of the cooler into an expanded position;

f) a first shoulder strap and a first hand grip are provided on the cooler, the first shoulder strap is attached to a middle of the front panel; and the first hand grip is attached to the front panel at the uppermost part of the front panel;

g) the front panel being foldable about the front hinge so that the front panel extends away from the cooler, and the surface on the front panel faces upwardly in the expanded position;

h) the front panel including a first front panel and a second front panel hingedly attached to the first front panel, the second front panel having a surface, and the second front panel being movable relative to the first front panel about an axis extending parallel to the front hinge into an expanded position, and the surface on the second front panel faces upwardly in an expanded position;

i) a third front panel hingedly attached to the first front panel, and a fourth front panel hingedly attached to the second front panel, the third front panel and the fourth front panel have respective surfaces thereon; and j) the third and fourth front panels being moved away from the first front panel and the second front panel about an axis extending transversely relative to the front hinge, respectively, and each of the respective surfaces faces upwardly in the expanded position; and k) a second left side wall is provided between the front wall and the rear wall; and the second left side wall and the first left side wall configure to form a pocket sized to accommodate one or more keys and cell phones; and l) a second shoulder strap and second hand grip are provided on the cooler, the second shoulder strap is attached to a middle of a rear panel; and the second hand grip is attached to the rear panel at an uppermost part of the rear panel.

2. The expandable cooler as claimed in claim 1, wherein:

a) a fifth front panel is hingedly attached to the first front panel, and a sixth front panel is hingedly attached to the second front panel, the fifth front panel and the sixth front panel have respective surfaces thereon; and b) wherein the fifth and sixth front panels are moved away from the first front panel and the second front panel, respectively, and each of the respective surfaces faces upwardly in an expanded position.

3. The expandable cooler as claimed in claim 2, wherein:

a) each of the first, second, third, fourth, fifth, and sixth front panels, respectively, has the same configuration as the front wall.

4. The expandable cooler as claimed in claim 1, wherein:

a) the rear panel is hingedly attached to the rear wall by a rear hinge located between the rear panel and the cooler, the rear panel having a surface and being movable away from the rear wall of the cooler into an expanded position; and b) the rear panel is foldable about the rear hinge so that the rear panel extends away from the cooler, and the surface on the rear panel faces upwardly in the expanded position.

5. The expandable cooler as claimed in claim 4, wherein:

a) the rear panel includes a first rear panel and a second rear panel hingedly attached to the first rear panel, the second rear panel has a surface, and the second rear panel is movable relative to the first rear panel and faces upwardly in an expanded position.

6. The expandable cooler as claimed in claim 5, wherein:

a) the rear panel has the same configuration as the rear wall.

7. The expandable cooler as claimed in claim 1, wherein:

a) a rear panel is hingedly attached to the cooler, a rear hinge is located between the rear panel and the cooler, the rear panel having a surface and being movable away from the rear wall of the cooler in an expanded position; and b) the rear panel is foldable about the rear hinge so that the rear panel extends away from the cooler, and the surface on the rear panel faces upwardly in the expanded position.

8. The expandable cooler as claimed in claim 1, wherein:

a) the axis extending transversely relative to the front hinge extends perpendicularly to the front hinge.

9. The expandable cooler as claimed in claim 1, wherein:

a) the axis extending transversely relative to the front hinge extends at right angles to the front hinge.

* * * * *